US009837698B2

(12) United States Patent
Lasier et al.

(10) Patent No.: US 9,837,698 B2
(45) Date of Patent: Dec. 5, 2017

(54) SMALL CELL COMMUNICATIONS POLE, SYSTEM, AND METHOD

(71) Applicants: David Lasier, Atlanta, GA (US); Jon VanDonkelaar, Bellbrook, OH (US)

(72) Inventors: David Lasier, Atlanta, GA (US); Jon VanDonkelaar, Bellbrook, OH (US)

(73) Assignee: ENERSPHERE COMMUNICATIONS LLC, Atlanta, GA (US)

( * ) Notice: Subject to any disclaimer, the term of this patent is extended or adjusted under 35 U.S.C. 154(b) by 73 days.

(21) Appl. No.: 14/722,885

(22) Filed: May 27, 2015

(65) Prior Publication Data

US 2015/0349399 A1 Dec. 3, 2015

Related U.S. Application Data

(60) Provisional application No. 62/004,991, filed on May 30, 2014.

(51) Int. Cl.

| | |
|---|---|
| ***H01Q 1/12*** | (2006.01) |
| ***H01Q 1/42*** | (2006.01) |
| ***H01Q 1/06*** | (2006.01) |
| *H05B 37/02* | (2006.01) |

(52) U.S. Cl.
CPC ..... *H01Q 1/1207* (2013.01); *H01Q 1/06* (2013.01); *H01Q 1/1242* (2013.01); *H01Q 1/42* (2013.01); *H05B 37/0272* (2013.01)

(58) Field of Classification Search
CPC ..... H01Q 1/1242; H01Q 1/06; H01Q 1/246; H01Q 1/42; H01Q 1/44; H01Q 1/1207
See application file for complete search history.

(56) References Cited

U.S. PATENT DOCUMENTS

| | | | | |
|---|---|---|---|---|
| 5,641,141 | A | 6/1997 | Goodwin | |
| 5,673,886 | A | 10/1997 | Negishi | |
| 5,963,178 | A | 10/1999 | Jones | |
| 6,134,422 | A | 10/2000 | Bobadilla et al. | |
| 6,173,537 | B1 * | 1/2001 | Davidsson ..... | E04H 12/08 343/890 |

(Continued)

OTHER PUBLICATIONS

Product Information featuring "Zero Site" Outdoor Small Cell Site Solution, Launch at the Mobile World Congress 2014 by Ericsson; pp. 1-13 (Feb. 21, 2014).

(Continued)

*Primary Examiner* — Robert Karacsony
(74) *Attorney, Agent, or Firm* — Thompson Hine LLP

(57) ABSTRACT

A communications system. The communications system includes a pole with an inner channel extending substantially an entire vertical height thereof, the pole being anchorable in a support surface. An antenna luminary assembly is received in the inner channel of the pole at an end thereof, the antenna luminary assembly including an antenna and a light source. The antenna luminary assembly is transitionable from an unlocked position where the antenna luminary assembly is rotatable about a central axis of the pole and a locked position where the antenna luminary assembly is non-rotatable about the central axis of the pole. A rotational position of the antenna luminary assembly relative to central axis of the pole defines a horizontal azimuth of the antenna.

20 Claims, 7 Drawing Sheets

(56) References Cited

U.S. PATENT DOCUMENTS

| | | | | |
|---|---|---|---|---|
| 6,222,503 | B1 | 4/2001 | Gietema et al. | |
| 6,335,709 | B1 | 1/2002 | Cummings | |
| 6,456,255 | B1 | 9/2002 | Lundahl | |
| 6,483,470 | B1 | 11/2002 | Hohnstein et al. | |
| D486,146 | S | 2/2004 | Dearnley | |
| 6,816,706 | B1 | 11/2004 | Hohnstein et al. | |
| 6,912,408 | B1 | 6/2005 | O'Neill et al. | |
| 6,940,469 | B2 | 9/2005 | Göttl et al. | |
| 6,987,769 | B1 | 1/2006 | Dougherty et al. | |
| 6,999,042 | B2 | 2/2006 | Dearnley et al. | |
| 7,106,273 | B1 | 9/2006 | Brunson et al. | |
| 7,406,298 | B2 | 7/2008 | Luglio et al. | |
| 7,616,170 | B2 | 11/2009 | Renfro et al. | |
| 7,706,757 | B2 | 4/2010 | Luglio et al. | |
| 7,755,561 | B2 | 7/2010 | Slattery | |
| 8,005,077 | B1 | 8/2011 | Dougherty et al. | |
| 8,035,574 | B2 | 10/2011 | Renfro et al. | |
| 8,098,605 | B2 | 1/2012 | Dougherty et al. | |
| 8,203,501 | B2 | 6/2012 | Kim | |
| 8,289,224 | B2 | 10/2012 | Halkiopoulos | |
| 8,457,027 | B2 | 6/2013 | Dougherty et al. | |
| 8,593,370 | B2 | 11/2013 | Caldwell et al. | |
| 8,624,793 | B2 | 1/2014 | Caldwell et al. | |
| 8,749,449 | B2 | 6/2014 | Caldwell et al. | |
| 8,845,152 | B2 | 9/2014 | Butler et al. | |
| 2009/0040750 | A1* | 2/2009 | Myer | F21S 8/083 362/183 |
| 2010/0231469 | A1* | 9/2010 | Kim | H01Q 1/246 343/721 |
| 2011/0047900 | A1 | 3/2011 | Holmes | |
| 2011/0309996 | A1 | 12/2011 | Abumrad et al. | |
| 2012/0154239 | A1* | 6/2012 | Bar-Sade | H01Q 1/1242 343/839 |
| 2013/0153738 | A1 | 6/2013 | Meiners et al. | |
| 2013/0186039 | A1 | 7/2013 | Ceko | |
| 2014/0065996 | A1* | 3/2014 | Dickie | H01Q 1/1242 455/269 |

OTHER PUBLICATIONS

"Rising Above" webpage of Valmont Structures; pp. 1-35; www.valmontstructures.com (retrieved from the internet on Jun. 4, 2015).

"Andrew® Metro Cell concealment solutions: Boost capacity in urban environments and minimize deployment costs" webpage of Commscope®, www.commscope.com; pp. 1-8 (2013).

"Ericsson lights up base stations with Philips" by Global Telecoms Business, http://www.globaltelecomsbusiness.com/Article/3312237/Search/Results/Ericcson-lights-up-base-stations-with-Philips.html?Keywords=lighting+as+a+service#.UwtGNnnCi9U (Feb. 24, 2014).

Ireland, Jay F. et al.; "FCC Amends Pole Attachment Rules to Promote Broadband Deployment"; Davis Wright Tremaine LLP, pp. 1-7; http://www.dwt.com/advsories/FCC_Amends_Pole_Attachment_Rules_to_Promote_Broadband_Deployment_04_08_2011/ (Apr. 8, 2011).

PCT, International Search Report and Written Opinion; International Application No. PCT/US15/32633 (dated Aug. 14, 2015).

* cited by examiner

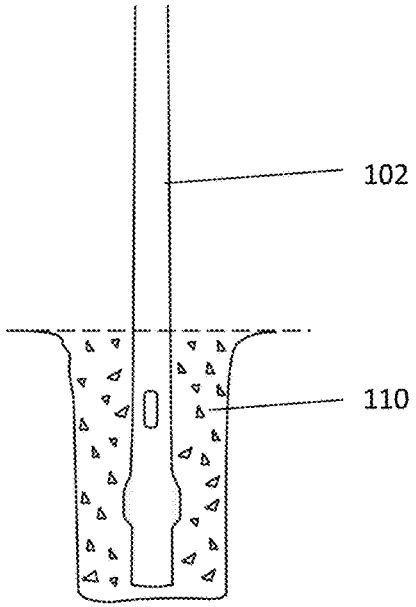
FIG. 10
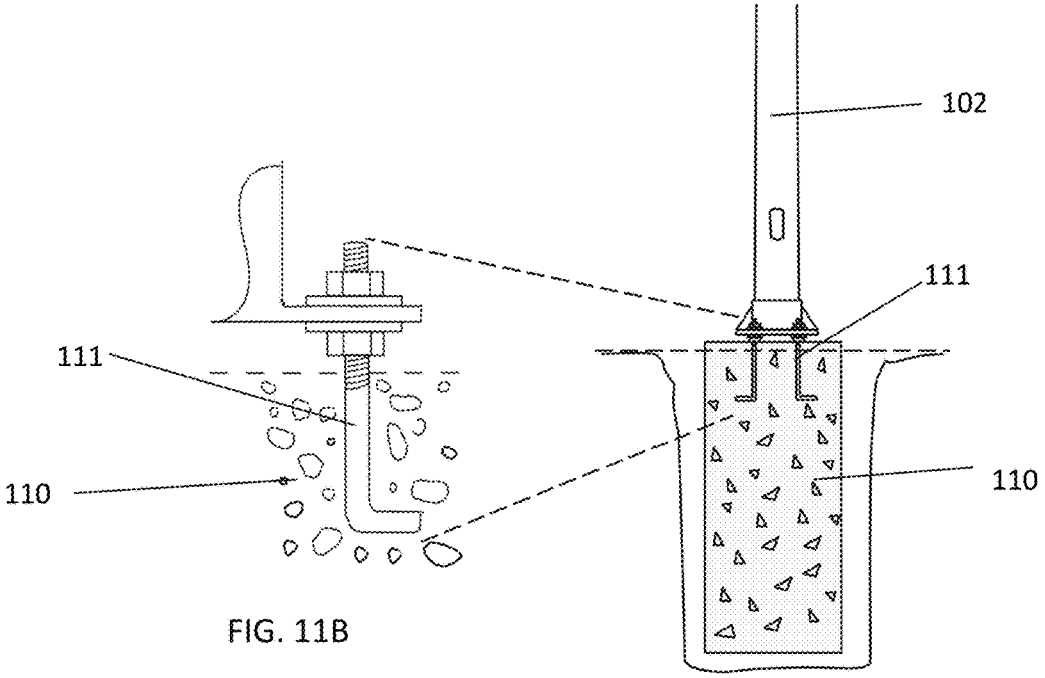
FIG. 11B
FIG. 11A

SMALL CELL COMMUNICATIONS POLE, SYSTEM, AND METHOD

RELATED APPLICATIONS

This application claims the benefit of U.S. Provisional Application No. 62/004,991, filed on May 30, 2014, the entirety of which is incorporated by reference herein.

TECHNICAL FIELD

The present disclosure relates to outdoor communications infrastructure, and more particularly to communications infrastructure such as small cells that facilitate deployment of mobile communication equipment and systems, and business methods that relate to such equipment and systems.

BACKGROUND

As the global popularity of smartphones, tablets and other mobile devices with larger screens and sharper images that support video and multi-user applications increase, the demand for mobile data grows exponentially. Accordingly, significant resources are being invested in mobile communication networks to accommodate the growing demand for mobile data. Traditional macro cells use high power radios (typically in the range of 30 W) to provide wide-area coverage, but have difficulty providing sufficient capacity to satisfy demand on a long-term basis, economically or operationally. In particular, though macro networks can provide wide-area coverage, many pockets of relatively poor coverage exist. To address the demand for mobile data and extend coverage, mobile infrastructure must be rapidly deployed. One of the most efficient ways to increase capacity is to reduce the macro cell's radius, creating a more densely packed network of smaller cells. To this end, small cells serve an important role in ensuring coverage to areas not properly serviced by macro cells, thereby helping to provide sufficient mobile Internet bandwidth to satisfy growing demand. In fact, the majority of expenditures for mobile network expansion in the near future are projected to be in small cells.

Small cells are fully integrated base stations with radio modules that vary in output power. Small cells typically operate at reduced power compared to macro cells, and are usually classified as microcells (typically having a power range of 5 W-30 W), picocells (typically having a power range of 1 W-5 W), or femtocells (typically having a power range of less than 1 W). Small cells are typically deployed at relatively low heights compared to macro cells (in some cases, between about 35 to about 50 feet above ground level and occasionally as high as about 70 feet). Despite the differences in architecture, power and form factor, the data rate for a small cell is typically the same as that for a macro cell. Microcells and picocells can operate independently or be coupled by fiber or microwave to one or more macro cells to transmit signals therebetween for integration into the mobile communications network.

Certain obstacles may impede the expanded use of small cells, such challenges include site acquisition, attachment rights to deploy necessary equipment, lack of deployment standards, public safety and aesthetic concerns, plus securing access to power and backhaul facilities. In addition, zoning, regulatory issues and often adversarial relationships between municipalities, utilities and mobile network operators ("MNO"s) may extend the time to market and increase total cost of ownership of small cells.

For example, in the context of pole attachment, MNOs face substantial challenges negotiating attachment rights, establishing power supplies to support the devices, and complying with federal, electric utility, and municipal regulations. Additionally, given the relatively small radius of coverage (about one mile, in some cases, or as small as about 500' in other cases), small cells must be located near the high-traffic areas which they serve, which places them within plain view of the public. As such, small cell deployment systems should be aesthetically pleasing and meet environmental and safety standards.

Small cells are currently and commonly deployed as external attachments to pre-existing wooden, steel and concrete poles, streetlights, and buildings. As such, unattractive, but functionally necessary, aspects of the small cells such as radios, power cords, antennae, and the like are haphazardly affixed to the pole or building in an aesthetically unappealing manner, with cordage and equipment exposed to the elements. As more functionality is added, more wires and bulky equipment are also needed, further detracting from the appearance of the pole or building and making maintenance and repair difficult.

SUMMARY

In one aspect, a communications system is disclosed. The communications system includes a pole with an inner channel extending substantially an entire vertical height thereof, the pole being anchorable in a support surface. An antenna luminary assembly is received in the inner channel of the pole at an end thereof, the antenna luminary assembly including an antenna and a light source. The antenna luminary assembly is transitionable from an unlocked position where the antenna luminary assembly is rotatable about a central axis of the pole and a locked position where the antenna luminary assembly is non-rotatable about the central axis of the pole. A rotational position of the antenna luminary assembly relative to central axis of the pole defines a horizontal azimuth of the antenna.

In another aspect, a communications system is disclosed. The communication system includes a small cell communications pole, the communications pole including a non-conductive, composite utility pole with an inner channel extending substantially an entire vertical height thereof. The utility pole is anchored in a support surface, and the utility pole is smoothly tapered along the entire vertical height thereof. The pole has a plurality of modular segments attached at generally smooth joints. The inner channel is adapted to receive at least one of Ethernet cables, power cables, ground cables, or wires. An antenna is mounted to an upper portion of the utility pole. A light source is mounted to the upper portion of the utility pole, the light source being dynamically controllable, and the antenna is integrated with the light source as a unitary assembly. The unitary assembly is generally weatherproof and bullet resistant to protect the interior thereof. An enclosure cabinet is mounted to a lower portion of said utility pole, the enclosure cabinet being entirely positioned above the support surface and providing access to the inner channel. A small cell backhaul system is mounted to the upper portion of the utility pole, the small cell backhaul system providing microwave backhaul. The utility pole is adapted to receive a photovoltaic coating, a camouflage wrapping, or advertising. At least one accessory component is mounted to the small cell communications pole, the accessory component being a cross arm, a transformer, an electrical insulator, an electrical outlet, a banner pole, or a light fixture. The system is NESC, ANSI, and at least EIA/TIA-222-Rev G compliant.

In yet another aspect, a method for replacing a utility pole with a small cell communications pole is disclosed. The method includes identifying an existing utility pole to be replaced, the existing utility pole being in compliance with a zoning requirement for a location at which the utility pole is situated, and removing the existing utility pole from the location. The method includes providing a small cell communications pole including an antenna mountable at or adjacent to an upper portion thereof, the small cell communications pole formed of a non-conductive, composite material. The small cell communications pole is NESC, ANSI, and at least EIA/TIA-222-Rev G compliant. The method involves installing the small cell communications pole at the location.

In yet another aspect, a pole system is disclosed. The pole system includes a plurality of poles anchored into the ground defining a line of poles, each pole supporting a utility line thereon. The utility line extends between each of the plurality of poles and is elevated above a ground surface by the plurality of poles, and at least one of the poles is a small cell communications pole. The plurality of poles provide remote communications to the plurality of poles for at least one of monitoring, controlling, or reporting a flow of electricity through the utility line.

The above and other features of the invention, its nature and various advantages will be more apparent upon consideration of the following detailed description, taken in conjunction with the accompanying drawings.

BRIEF DESCRIPTION OF THE DRAWINGS

FIG. 10 is a schematic view of a direct burial assembly installation of a communications system; and FIGS. 11A and 11B are views of an anchor-based assembly installation of a communications system.

DETAILED DESCRIPTION

Figure 1:
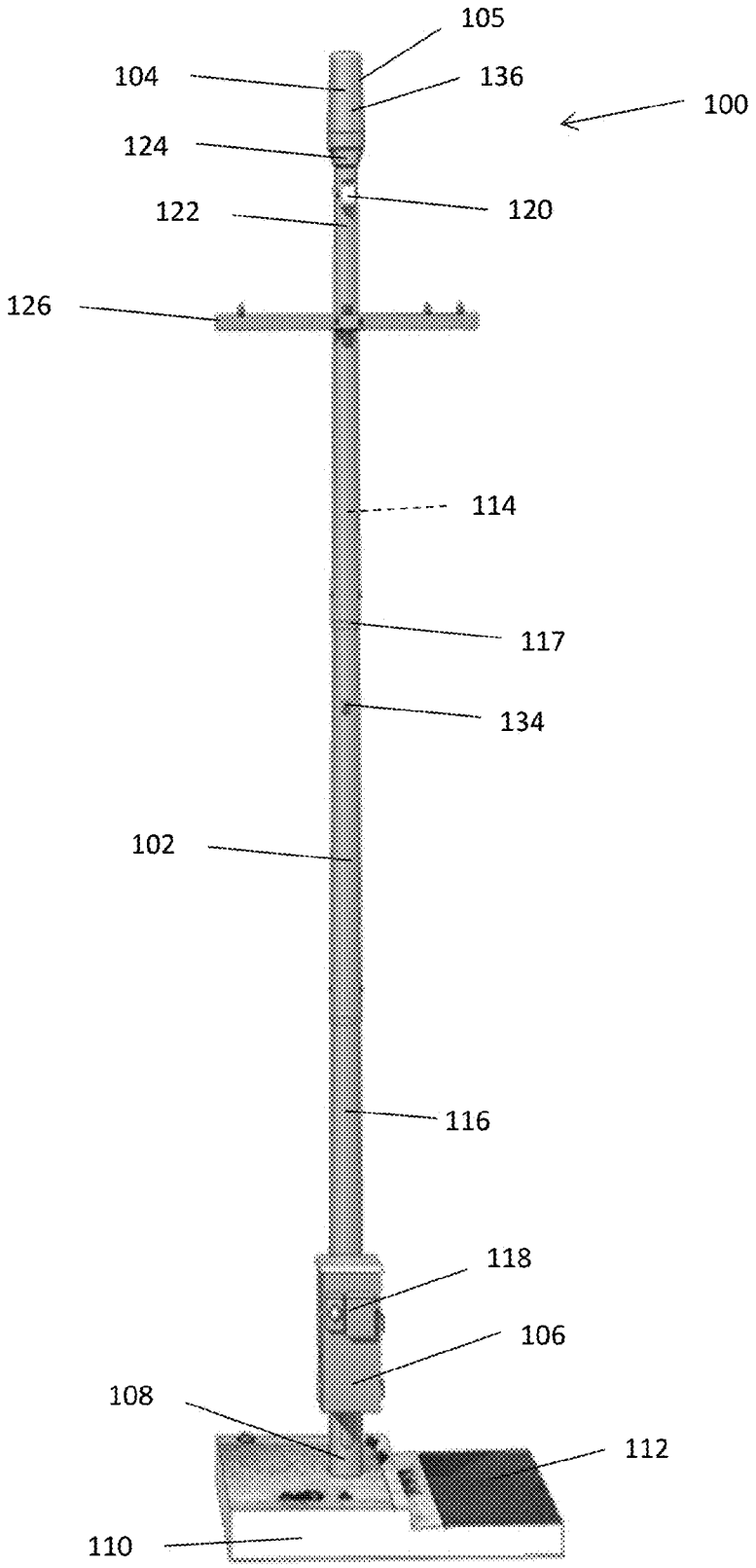
FIG. 1 is a front elevation view of one embodiment of a communications system.

The following detailed description illustrates the certain principles of the invention and embodiments thereof, examples of which are illustrated in the accompanying drawings. In the drawings, like reference numbers indicate identical or functionally similar elements.

Referring now to FIG. 1, the present system includes or takes the form of a small cell, communications system or system 100 including a pole 102, an antenna 104 located at or near a distal, top or upper end 122 of the pole 102/system 100, and an enclosure cabinet 106 located at or near a base 108 of the pole 102/system 100. The base 108 of the pole 102 is embedded in, coupled to or interfaces with a supporting surface 110, such as a ground surface, taking the form of a sidewalk beside a street 112 in the embodiment of FIG. 1. In this manner the pole 102 is supported in a configuration substantially perpendicular to the supporting surface 110. The pole 102 may be directly buried in the supporting surface 110, without the need for external support structures or guys, as shown in FIG. 10. Alternately, the pole 102 may be positioned generally entirely above the supporting surface 110, and a plurality of anchors 111 may be used to secure the pole 102 to the supporting surface 110, for example with bolts.

The pole 102 may extend to nearly any design vertical height, but in certain embodiments the system 100/pole 102 may be about 45, 50, or 70 feet tall, or less than about 100 feet tall. The pole 102 may in some cases have a diameter at its base 108 commensurate with the diameter of standard wooden utility poles, steel and concrete utility poles, and/or streetlights (e.g. about 18 inches in one case, or about 24 inches in another case), or less, although the base diameter can be selected to best match the desired height or configuration. The system 100/pole 102 may meet the standards set by the Electronics Industries Alliance ("EIA") and Telecommunications Industry Association ("TIA") for wind loading (EIA/TIA-222-Rev G), such as in one case be capable of withstanding a three second wind gust at 150 mph, or 60 mph with ¾ inch of ice. The communications system 100/pole 102 may also meet ANSI standards for utility poles.

The pole 102 may be hollow and include an inner channel 114 that extends substantially the entire height of the pole 102 or a portion thereof. The inner channel 114 may be configured to receive wires and/or cordage, such as coaxial cable, fiber optic cable, power cords, networking cable, speaker wire, and the like, in connection with the operation of the antenna 104 and/or other components of or accessories to the communications system 100. The inner channel 114 may be accessible from the enclosure cabinet 106, and the inner channel 114 may extend to and through the bottom of the pole 102/base 108 to facilitate interfacing with components, fiber optic and coaxial cable facilities, and electric power located within or below the supporting surface 110 through a defined ingress.

The pole 102, lightweight and modular in design, weighs significantly less than comparable wood, steel and concrete poles, and it may be constructed of non-electrically conductive materials to lessen the risk of damage from lightning strikes and to reduce short-circuits in the system. In one embodiment, the pole 102 is made of a fiber-reinforced synthetic resin material, available in multiple colors, and includes a smooth, graffiti-resistant finish. The pole 102 or portions thereof may be bullet resistant. A suitable pole 102 is disclosed in U.S. Patent Application Publication No. 2011/0047900, the entire contents of which are incorporated by reference herein. The pole 102 may be formed of a plurality of releasably attachable pole segments 116, which can be repeatedly assembled and disassembled without the use of specialized tools. Thus, if a particular pole segment 116 is damaged, a replacement pole segment 116 may be readily substituted without the need to replace the entire pole 102. The illustrated embodiments of the pole 102 include four pole segments 116, but any number of pole segments 116 may be used depending upon the total height of the pole 102 and the length of the individual pole segments 116 (which need not be uniform in length).

In one embodiment, the pole segments 116 that form the pole 102 have non-uniform outer diameters such that the each segment 116, and the assembled pole 102 as a whole tapers in diameter (continuously or step-wise) from one end to the other. The taper of the pole 102 is smooth and continuous even across the joints 117 between individual segments 116, which may strengthen the pole 102 and facilitate attachment of the cabinet 106, components, and accessory equipment. In addition, if desired an inner diameter of the larger (bottom) pole segments 116 that defines the inner channel 114 can be larger than the outer diameter of the smaller (top) pole segments 116. Such construction facilitates nesting of the pole segments 116 for efficient shipping, handling, and transport. Because the pole 102 is smooth and continuous across the joints 117 between individual segments 116, the pole 102 can be wrapped with camouflage, advertising, and/or photovoltaic (PV) materials to provide concealment, to increase revenue, to charge batteries, and/or to generate power for other components of the communications system 100. In other words, the absence of jagged or stepped edges between individual segments 116 simplifies attachment of the cabinet 106 and other features and accessories such as those described above because such items may be positioned flush against the pole 102 notwithstanding placement that may span more than one segment 116 across one or more joints 117.

The pole-mounted enclosure cabinet 106 is mounted to the pole 102 near the base 108, elevated off of/away from the support surface 110 in one case. The enclosure cabinet 106 can take the form of an enclosed case or the like with a removable or pivotable door to provide access to the internal contents of the enclosure cabinet 106 and/or inner channel 114. The enclosure cabinet 106 may house any of a variety of components, including electronics (for example, a load center with distribution and a generator plug), a circuit breaker panel, radio equipment, batteries, controllers, processors, sensors, controllers or the like, which can be used in connection with the antenna 104, LED luminary and light source 124, digital signage 132, and/or other components of the communications system 100. The enclosure cabinet 106 may include or be coupled to a service entry meter box 118. The enclosure cabinet 106 can be designed to meet the GR-487 Generic Requirements for Electronic Equipment Cabinets standard, to withstand winds at a speed of up to 150 mph, and/or to be National Electrical Safety Code ("NESC") compliant.

The enclosure cabinet 106 may be positioned to be partly or entirely accessible by a person standing on the support surface 110, in which case at least the lower portion thereof is no more than about 2 feet high in one case, or about 4 feet high in another case. The enclosure cabinet 106 thereby provides a readily accessible, above-ground access point for communications workers, in contrast with below-ground vaults and ground level pedestal cabinets, that may require environmental permits, or multiple boxes mounted on conventional utility poles, streetlights and buildings in some cases between 8 feet and 16 feet above the ground. In some embodiments, the enclosure cabinet 106 may be mounted higher on the pole 102, for example up to about 12 or 15 feet from the support surface 110.

The enclosure cabinet 106 may further include an internally-mounted light that is automatically turned on when the door to the cabinet 106 is opened, and/or opening the door may activate the LED luminary and light source 124. This feature ensures that light is provided for technicians performing maintenance on the communications system 100, and also serves as a deterrent/warning to persons who attempt to access the enclosure cabinet 106 without authorization.

The communications system 100 can include a Wi-Fi access point and/or backhaul system 120, which in one embodiment incorporates microwave backhaul functionality to provide data connectivity to macro cells, other small cells, and local data networks. The microwave backhaul system 120 provides point-to-point, point-to-multi-point, and non-line-of-sight wireless backhaul across both licensed and unlicensed spectra. The microwave backhaul system 120 is lightweight, weighing ten pounds or less in one case. Because it is microwave-based, the backhaul system 120 is not dependent on fiber availability. The backhaul system 120 may be positioned at any height on the pole 102, for example between about 35 and 50 feet above ground level, and in some embodiments may be at or proximate to the top portion 122 of the pole 102. Alternately or in addition to the backhaul system 120, the communications system 100 may include a fiber, coaxial cable, or other wired backhaul system, which may be positioned anywhere within or along the outside of the system 100, including within the cabinet 106.

The ALA, an integral component of the communications system 100, includes the antenna 104, an array antennae encased in a fiberglass dome or radome 105, which is located at the top 122 of pole 102 and mechanically attached to an LED luminary and light source 124, an assembly including an antenna adapter plate, mounting supports, and a cylindrical or a conical shaped aluminum casting 121 with LED strips or flexible circuit board(s) affixed to the surface of the casting or mounting supports for heat dissipation and structural support. One or more conically-shaped PC boards may alternatively be used. The light source 124 is protected from the environment by a surround 125, which may in one embodiment be formed of an acrylic hardened plastic. The aluminum casting blends the shape of the antenna to the shape (size) of the pole 102. The antenna 104, which in one embodiment is aesthetically indiscernible from the LED luminary and light source 124 as the ALA 136, may be configured to transmit radio or other signals as appropriate for the radios, components and accessories located in the enclosure cabinet 106 mounted to the pole 102, and can be EIA/TIA-222-Rev G compliant. The antenna 104 may be, in one case, a multi-band tri-sector antenna or alternately an omni or quasi-omni directional antenna, and in one embodiment, is capable of transmitting and/or receiving signals in the frequency range of about 698-960 MHz and/or 1710-2700 GHz. The antenna 104 may be operatively connected to multiple radios, accessories or components of the communications system 100 that may be required or interact with an antenna 104 and/or which are stand-alone accessories. Any wiring, such as for communications, power, remote electronic antenna tilt, etc., for such accessories or components can be positioned in the inner channel 114 of the utility pole 102. Thus, the communications system 100 provides ease of connection and mounting of antenna(e), while minimizing unappealing visual clutter in the form of multiple antennae and external wiring. Furthermore, the ALA 136 design, which seamlessly and aesthetically combines the antenna 104 with the LED luminary and light source 124, should expedite federal regulatory approval for communication system 100 because the antenna 104 is not visible to the average observer, and because the communication system 100 does not have a negative direct or visual effect when used to replace a pre-existing electric distribution pole or streetlight.

Figure 2:
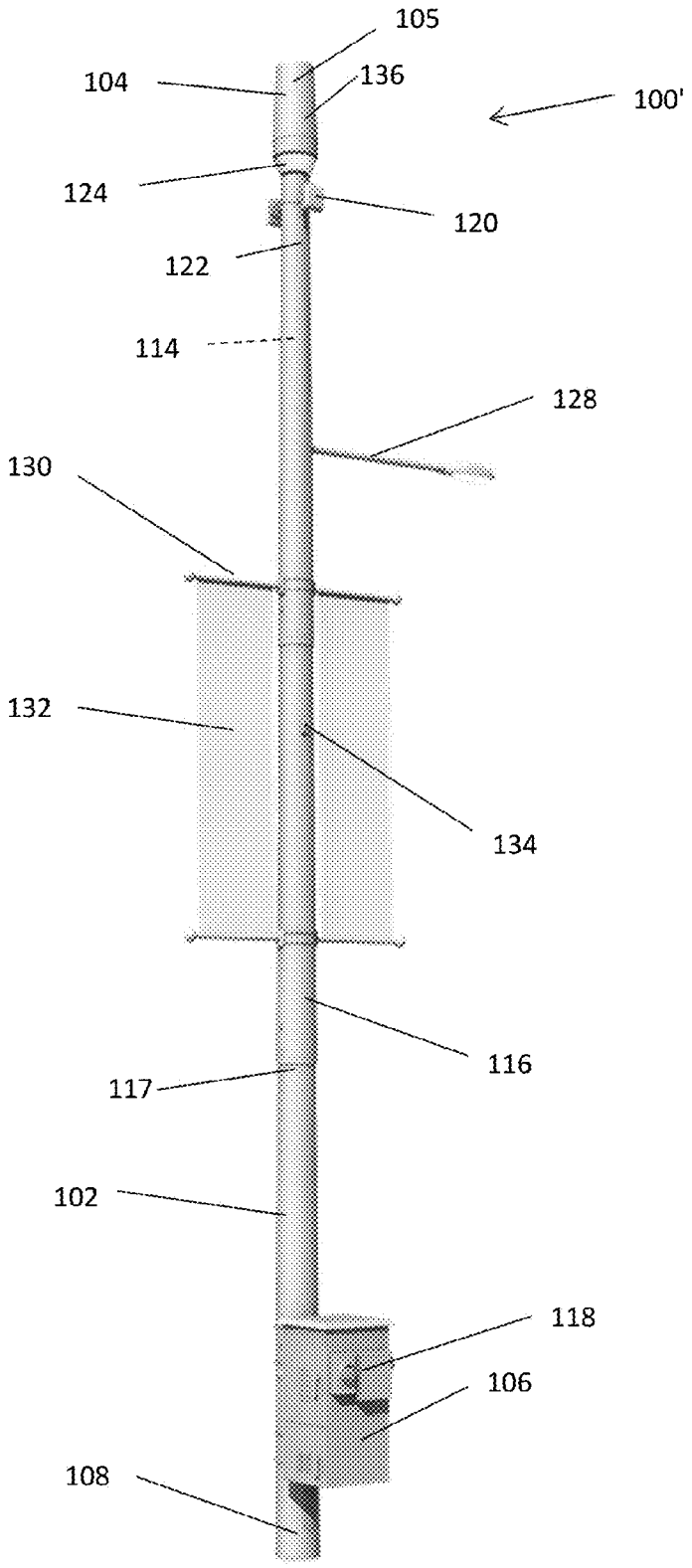
FIG. 2 is a front elevation view of another embodiment of a communications system.

Referring now to FIGS. 1 and 2, the communications system 100 may include any of a variety of devices, accessories, and components, some of which are shown in the drawings, to separately or simultaneously deliver applications that benefit multiple constituents including a) mobile communications; b) electricity distribution; c) IP-controlled LED lighting and digital signage; d) banner pole and wrapped print advertising; e) video surveillance; f) persistence surveillance; g) public safety, early warning and alarm and audible alert systems; h) seismic readings, weather alerts, vehicle traffic monitoring; i) mobile device monitoring and data analysis for location based advertising; j) crowd sensing collection and data management; k) smart grid Internet gateway functionality (for example, to accommodate Internet-based monitoring and control of advanced metering infrastructure and household appliances; 1) terrestrial GPS systems; and m) electric vehicle, mobile device, and appliance charging.

For example, in one case the communications system 100 may include an LED luminary or other light source 124 mounted at or adjacent to the upper end 122. The intensity of the output of light source 124 may be controllable such that the light source 124 is dimmable, and can provide displays of light across the entire visible (or, in some cases, invisible) spectrum, with changing colors and intensities. The light source 124 may be dynamically and remotely monitored and controlled from an IP-based management system that enables authorized personnel, organizations and government entities to remotely control the light source 124 (as well as other features of the system 100). The LED lighting 124 may be controlled manually or automatically from the enclosure cabinet 106, or by other suitable mechanisms, and it may be dynamically controllable or be programmed to run a pre-determined lighting programs. As compared to existing light sources, which may only include or be coupled to a light sensor or photovoltaic cell, the light source 124 can be dynamically controlled based on the GPS coordinates of the communication system 100, time zones (based on GMT), and local weather (for example, in response to weather alerts from the National Oceanic and Atmospheric Administration).

The light source 124 may be used in connection with a variety of public safety and/or municipal applications. For example, the light source 124 may provide an output in a particular light, pattern, intensity etc. to illuminate the pole 102 itself, to indicate that the communications system 100 requires maintenance or to signal tampering with the cabinet 106, to signal a warning to the public regarding weather conditions, such tornadoes, floods or the like, to signal other emergency situations (Amber Alerts, etc.), to signal functionality of the system 100 (for example, if the pole 102 includes an electric car recharge/fueling station, and the like. The light source 124 may be used to provide dynamic traffic updates such as by informing drivers of accidents or congestion on a road, giving them an opportunity to seek alternative routes. The light source 124 may be integrated into a public transportation system as a signal for the impending arrival of a bus or train, for example by accessing information from a GPS device on the public transportation vehicle within a set distance from the pole 102 to trigger a series of flashing lights of varying speed, intensity, and/or color which can be interpreted by passersby as indicating when the vehicle will arrive at a stop proximate to the pole 102. Further, the light source 124 may have ornamental use, for example to display red, white, and blue lights to enhance celebrations for the Fourth of July, to display colors of a local sports team, etc.

The remote, IP-based management system provides enhanced functionality to the communications system 100, in addition to control and implementation of the LED lighting functionality discussed above. LED lighting, audible alarm systems, video surveillance cameras and sensor technology attached to the pole 102, located in the ALA 136 and/or cabinet 106, may be remotely monitored and controlled from a web-based platform. The LED lighting, audible alarms, and video surveillance systems may be signaled and controlled automatically, scheduled in advance, or operated on-demand to operate based on the conditions detected by sensors (i.e. gunshot sound, severe weather, seismic tremor, power outage, public safety alert, cabinet door opened or tampering). The IP management system also permits dynamic control of digital advertising displayed on or wrapped around the pole 102, plus LED signage affixed to the pole 102, as well as marketing applications derived from mobile device data collected within the proximity of the pole 102 to facilitate cost-benefit analyses of purchasing advertising at a particular location.

Figure 13A:
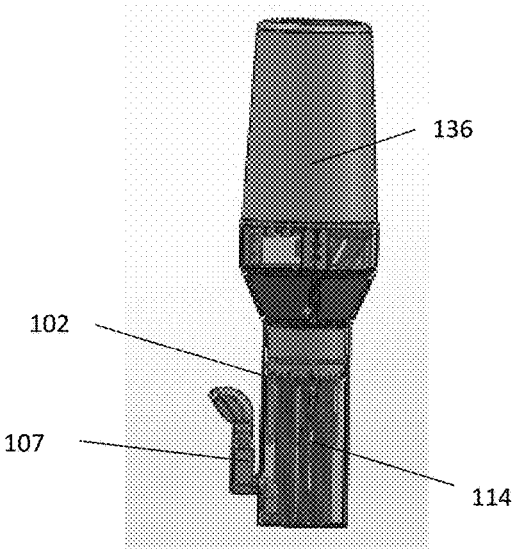
FIGS. 13A and 13B are partial cutaway views of an embodiment of a communications system incorporating tubing to accommodate power lines within the inner channel of the pole.
Figure 13B:
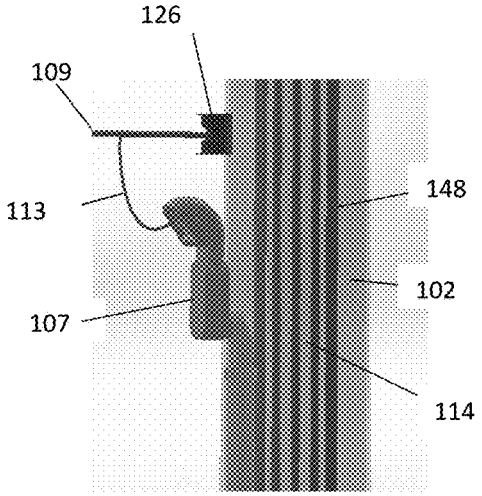

The communications system 100 may also include electric utility components and accessory equipment attached to the pole 102 such as transformers and one or more cross arms 126 mounted at or adjacent to the upper end 122 (FIG. 1). The cross arm 126 may extend generally perpendicular to the pole 102 and be formed of a variety of materials, including a fiberglass composite which weighs significantly less than a wood beam while providing increased strength. Each cross arm 126, may be between about 5 and 12 feet long, and provide the same benefits as conventional utility pole cross arms to support utility lines, including but not limited to power distribution lines, communication lines, etc. along with insulators and the like. Further, because the utility's electric distribution system (outside the pole 102) is electrically isolated from the wires running through channel 114 of the non-conductive pole 102 to the cabinet 106 (e.g. antenna cables, Ethernet, electric power for LEDs) the communications system 100 allows safe access to each of these systems by appropriate service personnel. This reduces installation and maintenance costs by permitting the use of less-skilled labor to safely service the communications aspects of the communication system 100 (i.e. through the cabinet 106) without coming into contact with the higher voltage distribution system carried by transformers and cross arms 126. In addition to strengthening the electric utility's distribution infrastructure, the communications system 100 provides enhanced functionality as compared to conventional utility poles, at reduced or similar costs, taking into consideration both material and labor costs. With reference to FIGS. 13A and 13B, in a case where power lines are transmitted through the channel 114 (for example to supply power to the cabinet 106 from the power lines 109 carried by the cross arms 126 via a branched power line 113 therefrom), the power lines may run through a dedicated series of conduits 107 to isolate the power lines from the communications-related cabling 148. The opening to facilitate passage of conduits 107 through the outer wall of pole 102 must be carefully sealed and weatherproofed. A similar arrangement to conduit 107 may be used to isolate ground wires running through the channel 114. Electric utility power and grounding may also be installed within the pole 102 using conduits to further isolate the two systems and to prevent copper theft.

The communications system 100 may also include one or more generally perpendicularly extending banner poles 130, as shown in FIG. 2. The banner poles 130 may be used to support banners 132 or advertising material, digital LED signage, or alternately to support other decorative objects such as lighted ornaments, wreaths, and hanging plant baskets. The illustrated communications system 100 includes a light fixture 128 configured to overhang and illuminate the associated ground surface such as roads, sidewalks, and the like near the communications system 100. The banner poles 130 and or light fixture 128 may be mounted using mounting blocks and banding, or various other structures.

The communications system 100 may also include one or more electrical outlets 134 which provide access to electric power, such as 110V and/or 220V or other power sources. The outlet 134 may include a waterproof cover to protect the outlet 134 from the elements. The electrical outlet 134 may be used to provide accessible AC power for seasonal decorative attachments, digital LED signage, and for use by maintenance workers, and the like.

The communications system 100 may include any of a variety of other accessories to provide enhanced capabilities. For example, a locally controlled or remotely controlled camera (not shown) can be mounted to the communications system 100 with its output streamed and/or stored for security, research or other purposes. In another embodiment, a sensor or sensors 135 (FIG. 6) may be mounted to the communications system 100, such as mobile device monitoring and motion sensors, which can determine the number and density of people, vehicles, etc. in the vicinity of the communications system 100, and/or detect when an individual is approaching. The ALA 136 may house technology that monitors the IP addresses of mobile devices within the radio frequency coverage area, or within a dynamic or fixed range of the GPS coordinates of the pole 102 (i.e. a geofence monitoring), and information gleaned in this way may be recorded and processed continuously or on a scheduled basis to define the total available market opportunity for mobile advertising applications based on location, time of day, and etc.

The system 100 can also include or utilize speakers to provide audible information, or music or the like to enhance community events and provide other functionalities. Many other accessories are possible, including attachments and features that serve as analogs to functionality typical of conventional utility distribution poles and street lights, and the communications system 100 may thus include any number of built-in mounting capabilities, in one embodiment without incorporating steel brackets, to attach radios, microwave radios, antennae, uninterruptable power supply ("UPS") systems, media converters, routers, and the like.

Figure 3:
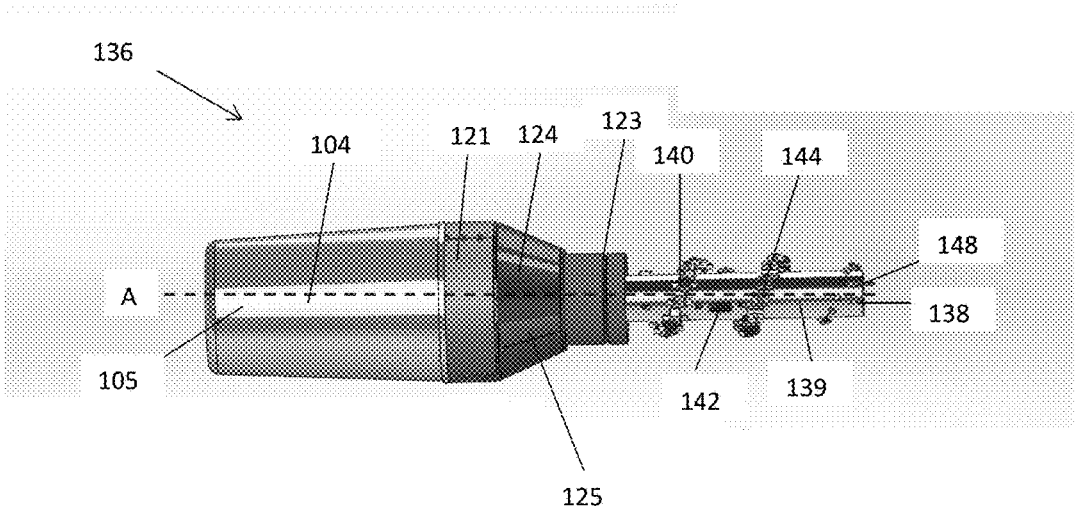
FIG. 3 is a side view of one embodiment of an antenna-luminary assembly ("ALA") for use with a communications system, such as the system of FIG. 1 or FIG. 2.
Figure 4:
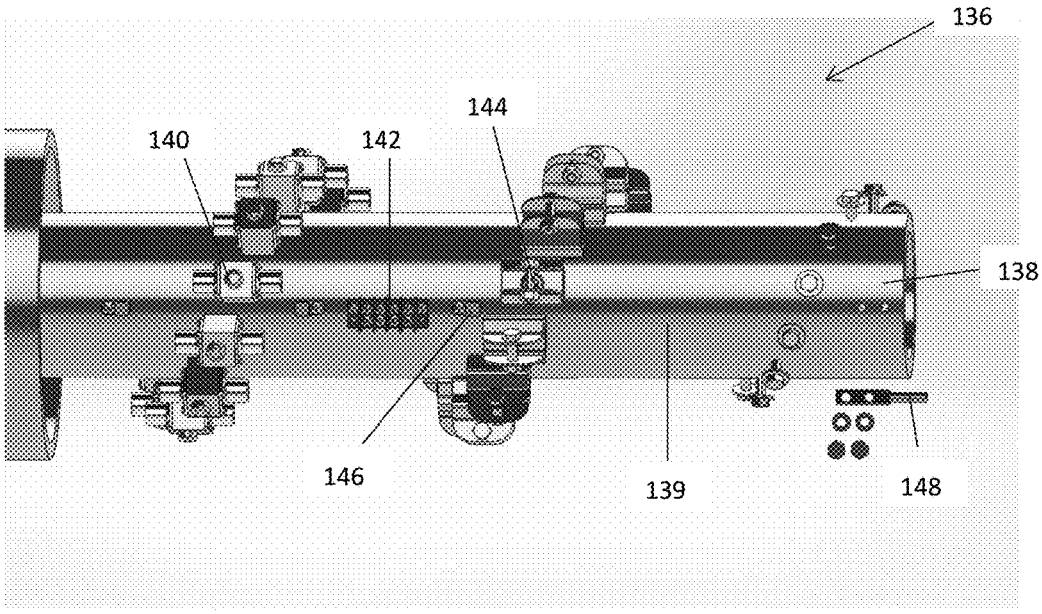
FIG. 4 is a detailed view of a portion of the ALA of FIG. 3.

Referring now to FIGS. 3 and 4, one embodiment of the ALA 136 is described in more detail. The ALA 136 is positioned at or adjacent to the top 122 of the pole 102, where in one case the male end 138 of the ALA 136 is received in the female inner channel 114 of the pole 102. The ALA 136 is rotationally oriented about a central vertical axis A of the pole 102 and ALA 136 to the desired horizontal azimuth of the antenna 104 and secured in place on the pole 102 via a plurality of setscrews 127 (best seen in FIG. 12 with respect to an alternate embodiment, ALA 136') inserted through pole 102 and into channel 123 of the ALA 136. The setscrew/channel 123 system facilitates easy adjustment of the horizontal azimuth at any angle by loosening the setscrews 127, rotating the ALA to the new desired position, and retightening the setscrews. This procedure can be accomplished quickly by a single person in a bucket truck, as compared to current antenna mounting systems, which often require climbing a tower or the use of a crane to separately adjust the azimuth of each antenna in a process that takes many hours.

The ALA 136 includes the antenna 104, the fiberglass dome or radome 105, the light source 124, a surge suppressor tube 139, a plurality of surge suppressors 140 to provide protection from lightning strikes or other surges, an LED terminal barrier strip or flexible printed circuit board 142, and cable pull hangers 144 to facilitate installation and integration of the ALA onto the pole 102 and the connection of coaxial cables, Ethernet cables, and etc., thereto. Some embodiments may lack particular features, such as the surge suppressor tube 139, the surge suppressors 140, and/or may include alternative arrangements to power/control the LED light source 124. The cables run on the outside of tube 139, but on the inside of the pole 102, when the system 100 is fully assembled. Electric power may by supplied via power cordage supplied through the inner channel 114 of the pole 102, and/or via PV film on the outside of the pole 102.

To install the ALA 136, the pole 102 is placed in its intended location, and the ALA 136 is lifted into place, for example with a three legged webbed lifting sling. Terminal lugs may be crimped to the ends of the cables, which may then be attached to the LED terminal barrier strip or flexible printed circuit board 142, which in turn is operatively connected to the light source 124. The ALA 136 further includes a cable tie block 146 to facilitate attachment of dressed cables below the barrier strip or flexible printed circuit board 142. A ground wire 148 may be attached to the bottom of the luminary surge suppressor tube 139, for example with hex bolts and split washers, and the DIN connectors of the coaxial cable may be connected to the surge suppressors 140 or the antenna and weatherproofed. Ground wire 148 may alternately run along the inside of the inner channel 114 or on the outside of the pole 102, but if run within inner channel 114, accommodations such as an insulated tube or housing may be included to isolate the ground wire 148 from the other contents of the inner channel 114, for example with a tube analogous to conduit 107 as earlier described and shown in FIGS. 13A, 13B. To relieve coaxial cable weight on the surge suppressors 140, the coax cables are first held by butterfly clamps 144, then sufficient coaxial cable may be pulled to provide some slack, which may be hung via the cable pull hangers. Once the cables are connected and additional weatherproofing and sealing performed, the ALA 136 may be inserted into the inner channel 114, with the antenna 104 rotationally oriented as necessary to the MNO's desired horizontal azimuth position, as earlier described via setscrews in the channel 123. Once positioned, the antenna 104 is secured by tightening the setscrews 127 located around the circumference of the upper end 122 of the utility pole 100 into the channel 123 in the ALA 136.

Figure 5:
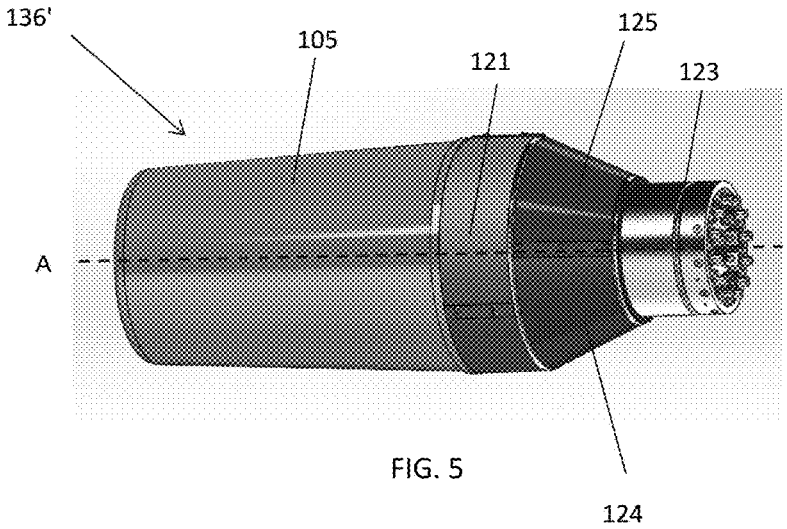
FIG. 5 is a side view of another embodiment of an ALA for use with a communications system.
Figure 6:
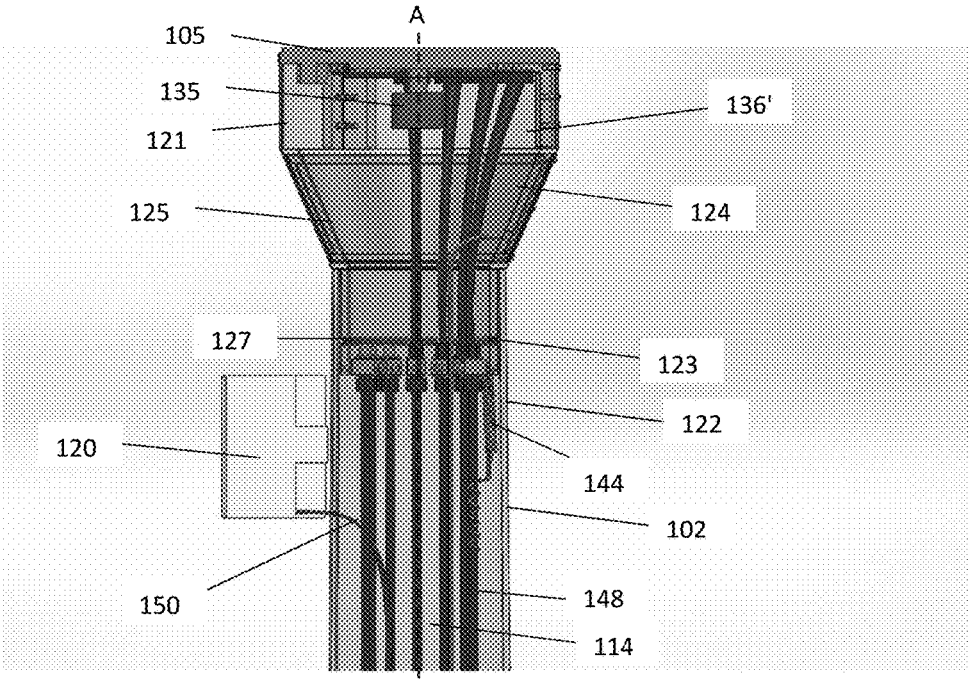
FIG. 6 is a partial cross-sectional view of the ALA of FIG. 5 mounted on a pole.
Figure 12:
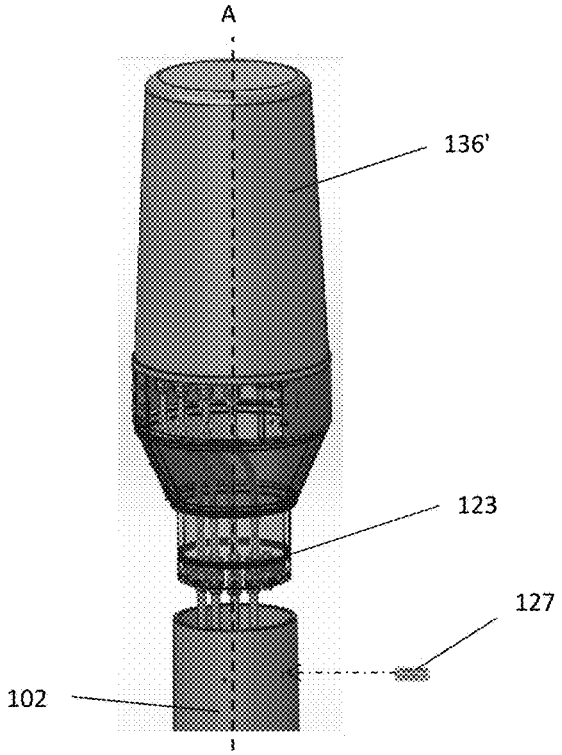
FIG. 12 is a disassembled view of the ALA and pole of FIG. 5 showing the setscrew.

Referring now to FIGS. 5, 6, and 12, an alternate embodiment of the ALA 136' is disclosed. Like ALA 136, ALA 136' includes the antenna 104, the fiberglass dome or radome 105 (not shown in full in FIG. 6), the light source 124, a cable pull 144, and other analogous components. However, instead of a surge suppressor tube, ALA 136' incorporates surge suppressors 140 mounted inside the housing of the ALA 136' (based on customer specifications some embodiments may not contain any surge suppressors at all). ALA 136' is a shorter version which is more compact and may be easier to install. Like ALA 136, a plurality of setscrews 127 inserted through pole 102 and into channel 123 are used to secure the ALA 136' to the pole 102 at the proper horizontal azimuth for the antenna 104. FIG. 6 also shows a variety of coaxial cables 148, Ethernet cables 150, and a power cable 152 representative of the contents of inner channel 114 where the pole 102 interfaces with the ALA 136'.

One benefit of the communications system 100 as disclosed herein is that the communications system 100 facilitates the economical and operationally efficient replacement of conventional distribution utility poles (i.e. wood, steel, concrete, etc.) and some streetlights with a more robust and useful structure. Because the communications system 100 is in some cases comparable in size and overall shape with conventional distribution utility poles and some streetlights and because the pole 102 and communications system 100 meets ANSI, NESC, and TIA 222 Rev G standards (and may be adapted to meet updated standards, as set forth from time to time by the pertinent authorities), site acquisition challenges inherent to many existing small cell systems can be avoided, such as the need to find a suitable new location and then secure agreements/approvals from a number of entities, including property owners, utilities, municipalities and various government jurisdictions.

The communications system 100 enables MNOs and electric utilities to comply with Federal Communication Commission regulatory rulings, which may significantly reduce the time required to complete zoning, permitting, and installation of mobile communications infrastructure from what currently may take over a year to less than a month. Because the communications system 100 complies with both NESC and ANSI standards, the pole 102 may be used to replace a utility pole, including any fiber optic, coaxial cable, and/or telephone attachments, while simultaneously supporting components and accessory equipment including transformers, cross arms, insulators, and/or power lines, and the like, from a typical electric utility pole. When the electric utility pole is removed, the pole 102 of the communications system 100 is simply installed directly into the same hole from which the electric utility pole was removed. Thereafter, the pre-existing attachments, components, accessory equipment, cross arms, and power lines, plus ALA 136 or 136", enclosure cabinet 106, cabling, etc., are attached to the pole 102 to complete the communications system 100.

Thus, rather than seeking new locations, existing conventional utility distribution poles and streetlights can be removed and replaced with the disclosed communications system 100 at the same, pre-approved location. By concealing unsightly wires within the channel 114 and by providing readily accessible, pre-planned attachment mechanisms for receiving additional accessories, as opposed to patchwork attachments to a wooden, steel or concrete pole, the communications system 100 will maintain its streamlined appearance despite changes to the attached accessories or components that may occur from time to time in accordance with changed functionality of the communications system 100. Thus, the system 100 can in fact provide a safer, more attractive appearance than the conventional utility distribution pole and/or streetlight being replaced.

Because the antenna 104 is mounted at the top of the pole 102, radio signals can propagate much further than the current and commonly deployed small cells today where antennae are mounted at lower heights on poles and buildings. By situating the antenna 104 at the top of the pole 102, the MNO achieves maximum coverage and capacity, thus requiring fewer small cells to provide service, which reduces the MNO's total cost of ownership ("TCO").

Similarly, because the system 100 meets the utility industry's ANSI and NESC safety, structural and attachment requirements for distribution poles and streetlights, the system 100 can operate as a utility distribution pole supporting high voltage transformers and electrical lines on cross arms 126, with cable television, fiber optic lines, street lighting fixtures and other devices attached to the pole 102.

Further, the inclusion of the pole 102 as a component in an electric distribution line of a series of electric utility poles effectively hardens the line of poles against wind or traffic damage due to the increased structural strength of the pole 102 as compared to, for example, a wooden utility pole. Each pole in a line of utility poles is meant to have a balanced load. Equal spans of cable are usually put on both sides of the poles so that their respective loads cancel and become strictly a downward load on the pole. The wires from the neighboring poles help to keep each pole standing straight up, so the individual poles in the line provide mutual support for each other. This means that the poles can be lighter and have shallower foundations than, for example, if each pole were required to carry a one sided load. (A guy wire can provide the load canceling function if the pole is a dead end for the wires.)

However, when a strong wind blows in a direction perpendicular to the distribution line, the neighboring poles in the line do not provide significant support to a given pole that is not strong enough to withstand the wind, and the pole can be blown over. In this situation, the mutual support system across the line of poles becomes a detriment because when one pole falls, the adjacent wires will pull down the next pole which in turn pulls down the next pole, causing a chain reaction of downed poles.

However, the disclosed pole 102 is significantly stronger than standard utility poles. Accordingly, by replacing the utility poles in the line of poles with the much stronger pole 102, the risk of wind damage is greatly reduced. Further, even replacement of periodic poles (for example, by replacing only every second, third, fourth, fifth, tenth, etc., pole, as opposed to each and every pole) functions to harden the entire line of poles against strong damaging winds because the superior strength of the pole 102 over standard wooden or fiberglass utility poles permits the pole 102 to shoulder the increased load of neighboring poles that would otherwise lead to a chain reaction of pole failures.

The communications system 100 structural design results in significant strength increase over wood and fiberglass utility poles. This allows the pole 102 to carry over 8,000 pounds of distribution transformers, while at the same time meeting both the power industry standards for utility poles as well as the communications industry standards for cell towers. Wood poles may meet ANSI 05.1 "Specifications and Dimensions for Wood Poles" and ASTM D1036 "Standard Test Methods of Static Test of Wood Poles, but wood poles do meet the standards set by the Electronics Industries Alliance ("EIA") and Telecommunications Industry Association ("TIA") for wind and ice loading (EIA/TIA-222-Rev G) of communications towers, which the pole 102 does meet. The pole 102 also meets the appropriate National Electric Code and National Electric Safety Code for safe electrical wiring practices.

Another benefit of the pole 102 is that through its back haul communications to the main cell tower, the pole 102 provides "last mile communications" to a system of poles for line segmentation, SCADA (supervisory control and data acquisition), metering, pole top substations, voltage regulation, frequency regulation, and other grid operation functions. SCADA is a process control system that enables a utility to monitor and control the flow of electricity from their generators to their customers via smart devices that are distributed among various remote sites. Expensive dedicated fiber or microwave can be justified at large substations or power plants, but small switching sites or metering points require inexpensive communications solutions. A properly designed SCADA system saves time and money by eliminating the need for service personnel to visit each site for inspection, data collection/logging or making adjustments. Just a few of the benefits that come with SCADA systems are real-time monitoring and control, system modifications, troubleshooting, increased equipment life, and automatic outage report generating. The way the data network is set up can vary, but it must have uninterrupted, bi-directional, secure, and inexpensive communication for the system to function properly.

The communication system 100 structural design, features and functionality enables multiple constituents to use the same system 100 and pole 102, which lowers the TCO, improves time-to market and provides revenue generating opportunities for the system 100 owner and interested parties including the electric utility, MNO, municipality, government and backhaul companies, plus business intelligence, marketing, advertising and other organizations.

Figure 7:
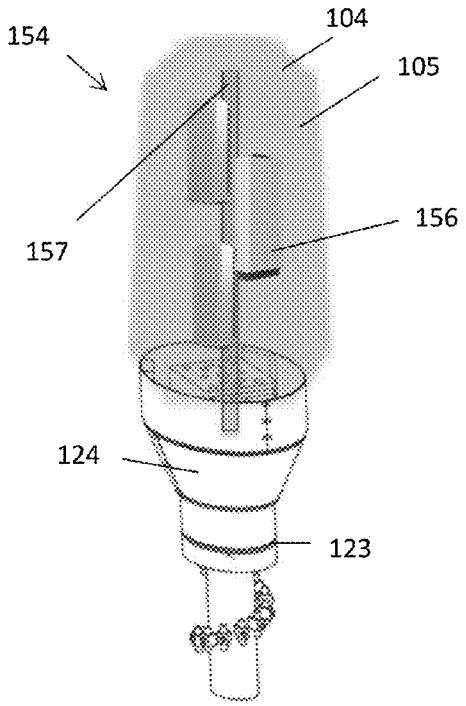
FIGS. 7-9 are front elevation views of three embodiments of a Picocell radome for deployment on a pole in accordance with the disclosed communications system.
Figure 8:
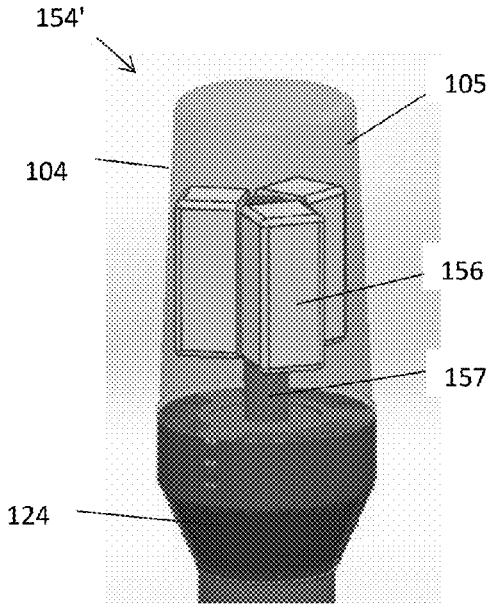
Figure 9:
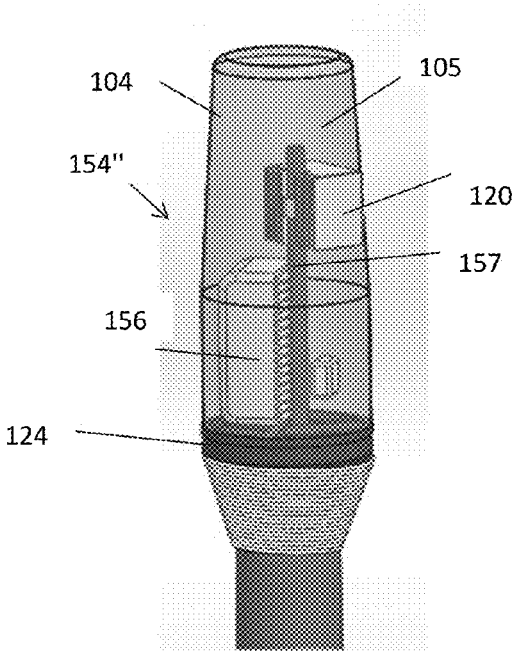

Further, the nested, modular structure of the pole 102 allows the pole 102/communications system 100 to be shipped in standard shipping containers (for example 20 or 40 feet long), and the individual pole segments 116 can be sufficiently light to be sling carried by two workers, which enables relatively easy installation even in generally hard-to-reach locations, while simultaneously providing a stronger and lighter pole due to the composite construction. The internal access for communication cables eliminates excess cabling, steel brackets and other conventional features that increase costs for conventional utility distribution poles. Referring now to FIGS. 7-9, ALAs 154, 154', and 154" are disclosed with respect to an alternative embodiment of the communication system 100 designed to serve as a picocell as opposed to a microcell. The components and functionality of the pole 102 and related features perform in the same way as earlier described, and the general ALA structure and connective features are analogous to the embodiments discussed above with respect to ALA 136, 136'. However, unlike the microcell embodiment of the communications system 100, the picocell ALA 154, 154', 154" incorporates one or more radios with a built-in antenna 156 mounted to a mast or cylindrical structure 157 within a radome 105, which in one embodiment is formed of opaque fiberglass, as opposed to the placement of the radios in the cabinet 106 connected by coaxial cables 148 to the antenna 104 of the ALAs 136 and 136' in the microcell embodiment. In one embodiment, the picocell ALA 154, 154', 154" includes three radios 156 and may further include microwave, Wi-Fi, and sensors 135 as earlier described in FIG. 6. In addition to providing horizontal azimuth control via rotational positioning about pole 102, the picocell ALA 154, 154', 154" may provide vertical azimuth control by repositioning the radios 156 therein on the mast 157. Network equipment, batteries, controllers, and etc. are located in the cabinet 106. As shown in FIG. 9, the microwave backhaul 120 may also be positioned within the radome 105.

Although the invention is shown and described with respect to certain embodiments, it should be clear that modifications will occur to those skilled in the art upon reading and understanding the specification, and the present invention includes all such modifications.

What is claimed is:

1. A communications system comprising:

a hollow pole with an inner channel extending substantially an entire vertical height thereof, said pole being anchorable in or to a support surface;

an antenna assembly attached to a top of the pole and at least partially positioned in the inner channel of said pole at an end thereof having at least a portion protruding vertically upwardly beyond said pole, the antenna assembly including an antenna;

wherein the antenna assembly is transitionable between an unlocked position wherein the antenna assembly is rotatable about a central axis of the pole and a locked position wherein the antenna assembly is non-rotatable about the central axis of the pole;

a plurality of setscrews or fasteners positioned in a wall of the pole at an upper end of said pole and aligned with a channel positioned about the antenna assembly located in the inner channel, wherein the setscrews or fasteners are configured to releasably couple the pole and the antenna assembly on the top of said pole; and wherein a rotational position of the antenna assembly relative to central axis of the pole defines a horizontal azimuth of the antenna and the location of the channel positioned about the antenna assembly located in the inner channel relative to the top of said pole defines a vertical position of the antenna.

2. The communications system of claim 1, wherein the communication system further comprises a plurality of fasteners configured to releasably couple the pole and the antenna assembly, wherein the fasteners are releasable to facilitate transition of the antenna assembly between the unlocked position and the locked position.

3. A communications system comprising:

a pole including an inner channel extending substantially an entire vertical height thereof, said pole being anchorable in or to a support surface;

an antenna assembly at least partially positioned in the inner channel of the pole at an end thereof, the antenna assembly including an antenna;

wherein the antenna assembly is transitionable between an unlocked position wherein the antenna assembly is rotatable about a central axis of the pole and a locked position wherein the antenna assembly is non-rotatable about the central axis of the pole;

wherein a rotational position of the antenna assembly relative to central axis of the pole defines a horizontal azimuth of the antenna, wherein the communication system further comprises a plurality of fasteners configured to releasably couple the pole and the antenna assembly, wherein the fasteners are releasable to facilitate transition of the antenna assembly between the unlocked position and the locked position, and, wherein the antenna assembly includes a channel about a lower end thereof, wherein the fasteners are at least partially positioned within the channel when the antenna assembly is in the locked position.

4. The communications system of claim 3, wherein the channel extends about an entire outer circumference of the lower end of the antenna assembly.

5. The communications system of claim 1, wherein the pole is smoothly tapered along the entire vertical height thereof, wherein the pole comprises a plurality of modular segments attached at joints, and wherein said pole is smoothly tapered at each joint and at either side thereof.

6. The communications system of claim 5, further comprising an enclosure cabinet, or a photovoltaic wrapping, or a camouflage wrapping, or a pivotable door to provide access to the inner channel, or a curved component at least partially wrapping around said pole, or an advertisement positioned over at least one joint.

7. The communications system of claim 1, further comprising an enclosure cabinet attached to the pole or further comprising a pivotable door to provide access to said inner channel, the system further including wiring that extends between the enclosure cabinet or the door and the antenna assembly, wherein the wiring is positioned within the inner channel of the pole.

8. The communications system of claim 1, wherein the antenna assembly further includes a light source, and wherein the light source is operatively connected to a web-based management system that is configured to dynamically or automatically control at least one of a color, a pattern, or an intensity of an output of the light source in response to information accessed by or provided to the management system in connection with at least one of public safety, weather, an amber alarm, national terrorism levels, a hospital zone, a holiday and a local sporting event.

9. The communications system of claim 1, further comprising at least one accessory component mounted to said pole, said accessory component comprising a cross arm, or an electrical outlet, or a banner pole, or a surveillance camera, or a backhaul system, or a Wi-Fi access point, or a light fixture.

10. The communications system of claim 1, further comprising:

an electric utility cross arm attached to the pole adapted to receive or support electrical wires outside of the pole;

a conduit with an opening proximate to the cross arm adapted to receive at least one of an electrical wire, an electrical ground wire, or a neutral wire, wherein the conduit passes through an exterior of the pole at a location thereof proximate to the cross arm, the conduit extending into the inner channel, and extending vertically through at least a portion of the vertical height of the pole, wherein an interior of the conduit is electrically isolated from a remaining portion of the inner channel.

11. The communications system of claim 1, wherein the system is NESC, ANSI, and at least EIA/TIA-222-Rev G compliant.

12. The communications system of claim 1 wherein said pole is made of a non-electrically conductive material.

13. The communications system of claim 1 wherein said pole is made of metal.

14. The communications system of claim 1 wherein the antenna provides radio communications or Wi-Fi communications.

15. The communications system of claim 1 further including a light source including light-emitting diodes affixed to a lower perimeter of the antenna assembly with an electric utility cross arm attached to said pole adapted to receive or support electrical wires outside of the pole.

16. The communications system of claim 1 wherein the antenna includes an array of antennae encased in a fiberglass dome or radome.

17. The communications system of claim 1 further including a sensor mounted to an upper portion of said pole to the antenna assembly or positioned in a radome, said sensor being integrated with the antenna assembly and configured to transmit and receive data.

18. The communications system of claim 1 wherein said at least a portion of said antenna assembly protrudes vertically upwardly beyond said pole and is an upper-most component of said communications system.

19. The communications system of claim 1 wherein another portion of said antenna assembly includes a cylindrical and hollow component with a channel that extends about an outer circumference thereof, which is positioned in the inner channel of said pole.

20. A communications system comprising:

a hollow pole with an inner channel extending substantially an entire vertical height thereof, said pole being anchorable in or to a support surface;

an antenna assembly that is attached to a top of said pole, wherein said antenna assembly includes an antenna or array of antennae encased in a dome or radome positioned at a top of the antenna assembly, wherein the antenna assembly includes an antenna adapter plate and mounting supports to support the dome or radome; and a light source with light-emitting diodes affixed to the lower perimeter of the antenna assembly;

wherein the antenna assembly includes a cylindrical and hollow component with a channel that extends about the outer circumference thereof, and which extends into the inner channel of said pole;

wherein the channel that extends about the outer circumference of the cylindrical and hollow component of the antenna assembly that extends into the inner channel of said pole is configured to receive setscrews or fasteners therein to secure the rotational position of the antenna assembly relative to a central axis of the pole and the location of the channel positioned about the antenna assembly located in the inner channel relative to the top of said pole defines a vertical centerline of the antenna;

wherein the antenna assembly is transitionable between an unlocked position wherein the antenna assembly is rotatable about a central axis of the pole and a locked position wherein the antenna assembly is non-rotatable about the central axis of the pole;

and wherein the system further includes a plurality of setscrews or fasteners positioned in a wall of the pole at the upper end of said pole and aligned with the channel positioned about the antenna assembly located in the inner channel, wherein the setscrews or fasteners are configured to releasably couple the pole and the antenna assembly on the top of said pole; and wherein a rotational position of the antenna assembly relative to central axis of the pole defines a horizontal azimuth of the antenna.

* * * * *